US009150351B2

(12) United States Patent
Decker et al.

(10) Patent No.: US 9,150,351 B2
(45) Date of Patent: Oct. 6, 2015

(54) STORAGE CONTAINER

(75) Inventors: Nicholas Decker, Concord, NC (US); Bradley Hooley, Charlotte, NC (US); David McNamara, Huntersville, NC (US)

(73) Assignee: RUBBERMAID INCORPORATED, Huntersville, NC (US)

( * ) Notice: Subject to any disclaimer, the term of this patent is extended or adjusted under 35 U.S.C. 154(b) by 339 days.

(21) Appl. No.: 13/296,731

(22) Filed: Nov. 15, 2011

(65) Prior Publication Data

US 2012/0121212 A1 May 17, 2012

Related U.S. Application Data

(60) Provisional application No. 61/414,166, filed on Nov. 16, 2010.

(51) Int. Cl.

| | |
|---|---|
| ***B65D 33/00*** | (2006.01) |
| ***B65B 67/12*** | (2006.01) |
| ***B65B 67/04*** | (2006.01) |
| ***B65D 85/62*** | (2006.01) |
| ***B65D 25/14*** | (2006.01) |
| ***B65D 35/14*** | (2006.01) |
| ***B65D 90/00*** | (2006.01) |
| ***B65F 1/00*** | (2006.01) |
| ***B65F 1/14*** | (2006.01) |
| *B65F 1/06* | (2006.01) |

(52) U.S. Cl.

CPC ..... *B65F 1/006* (2013.01); *B65F 1/1436* (2013.01); *B65F 1/1468* (2013.01); *B65F 1/1646* (2013.01); *B65F 1/06* (2013.01); *B65F 2220/124* (2013.01); *Y10T 29/49826* (2015.01)

(58) Field of Classification Search

CPC ..... B65F 1/06; B65F 1/1415
USPC ..... 383/33; 248/95, 100, 101; 206/503; 220/495.08
See application file for complete search history.

(56) References Cited

U.S. PATENT DOCUMENTS

| | | | | |
|---|---|---|---|---|
| 1,840,616 | A | | 1/1932 | Burke |
| 2,145,613 | A | | 1/1939 | Shenk et al. |
| 2,202,238 | A | | 5/1940 | Thompson |
| 3,008,604 | A | | 11/1961 | Garner |
| 3,443,745 | A | | 5/1969 | Kleeberg |
| 3,799,391 | A | | 3/1974 | Brescia |
| 3,870,261 | A | * | 3/1975 | McSwain ..... 248/101 |
| 4,223,858 | A | * | 9/1980 | de Salazar ..... 248/101 |
| 4,550,440 | A | * | 10/1985 | Rico ..... 383/33 |
| 4,630,752 | A | | 12/1986 | DeMars |
| 4,669,690 | A | * | 6/1987 | McEniry ..... 248/101 |
| 4,753,367 | A | | 6/1988 | Miller et al. |
| 4,765,579 | A | | 8/1988 | Robbins, III et al. |
| 4,776,478 | A | | 10/1988 | Miller et al. |
| 4,917,263 | A | | 4/1990 | Korb |

(Continued)

OTHER PUBLICATIONS

HMS Mgf.; www.hmsmfg.com/products/housewares/2158.htm; 1 page.

(Continued)

*Primary Examiner* — Jes F Pascua
*Assistant Examiner* — Derek Battisti
(74) *Attorney, Agent, or Firm* — Marshall, Gerstein & Borun LLP

(57) ABSTRACT

A storage container comprises a cleat configured to be connected to a structure. A lid is pivotably connected to the cleat. A bag support is releasably connected to the cleat separate from the lid. A bag is supported by the bag support.

13 Claims, 10 Drawing Sheets

(56) References Cited

U.S. PATENT DOCUMENTS

| | | | | |
|---|---|---|---|---|
| 4,953,740 | A * | 9/1990 | Koda | 220/263 |
| 4,957,252 | A * | 9/1990 | Watkins | 248/97 |
| 5,020,751 | A * | 6/1991 | Larkin | 248/99 |
| 5,242,074 | A | 9/1993 | Conaway et al. | |
| 5,310,078 | A | 5/1994 | Strawder | |
| 5,480,113 | A * | 1/1996 | Hachenberg | 248/100 |
| 5,628,424 | A | 5/1997 | Gola | |
| 5,735,495 | A | 4/1998 | Kubota | |
| 5,803,300 | A | 9/1998 | DeMars | |
| 6,488,241 | B1 * | 12/2002 | Kyte et al. | 248/95 |
| D480,295 | S * | 10/2003 | Scola | D8/373 |
| 6,659,407 | B2 * | 12/2003 | Asaro | 248/97 |
| 6,959,833 | B1 | 11/2005 | Paul | |
| 7,401,708 | B2 * | 7/2008 | Lin | 220/23.87 |
| 8,066,144 | B2 | 11/2011 | McNamara et al. | |
| 2003/0108254 | A1 * | 6/2003 | Watkins | 383/23 |
| 2004/0074907 | A1 | 4/2004 | Gardner | |
| 2004/0238553 | A1 | 12/2004 | Lane et al. | |
| 2005/0205579 | A1 | 9/2005 | Buchalter et al. | |
| 2009/0261105 | A1 | 10/2009 | Cunningham et al. | |
| 2010/0252694 | A1 * | 10/2010 | Bathols et al. | 248/101 |

OTHER PUBLICATIONS

Sterilite; www.sterilite.com/Category.html?Section=Household &ProductCategory=55; 1 page.

PCT International Search Report dated Jan. 28, 2009.

* cited by examiner

STORAGE CONTAINER

This application claims benefit of priority under 35 U.S.C. §119(e) to the filing date of to U.S. Provisional Application No. 61/414,166, as filed on Nov. 16, 2010, which is incorporated herein by reference in its entirety.

BACKGROUND

The invention relates to storage containers and more particularly to temporary storage of recyclable materials and the like. Recycling programs are relatively common in most communities. Many recycling programs require the user to store recyclable articles and to periodically bring the recyclables to a pick-up destination that may be a public recycling center or curbside. The temporary storage of recyclables is a problem in the home environment.

SUMMARY

A storage container comprises a cleat configured to be connected to a surface. A lid is pivotably connected to the cleat. A bag support is removeably connected to the cleat separate from the lid. A bag is supported by the bag support.

The bag may be made of a relatively flexible material. The bag may comprise an opening where the lid is movable between a first position where the opening is covered and a second position where the opening is uncovered. The bag support may comprise a rim that is dimensioned such that it is shaped and sized to conform to the opening of the bag. The bag may be attached to the rim such that the bag may be suspended from the rim where the rim maintains the bag in an open position. The bag may be attached to the bag support using a releasable connection mechanism. The bag may comprise a flap where the bag is positioned on the rim such that a side wall of the bag is located inside of the rim and the flap extends over the rim such that the rim is disposed in the space between the flap and the sidewall. The rim may be provided with a protrusion that is inserted into a slit formed on the flap. The bag support may comprise a hook, and the cleat may comprise a slot where the hook is inserted into the slot to connect the bag support to the cleat. A handle may be pivotably secured to the bag support movable between a retracted storage position and a deployed position where the handle may be used to carry the bag assembly. The lid may pivot approximately 180 degrees between a first position where it extends upward substantially vertically from the cleat and a second position where it extends downward substantially vertically from the cleat. A hook may be connected to the cleat for suspending the cleat from a structure.

A storage container comprises a cleat configured to be connected to a structure, the cleat comprises an upwardly opening slot. A lid is pivotably connected to the cleat. A bag support comprises a hook that is inserted into the slot to suspend the bag from the cleat. A bag is supported by the bag support wherein the bag comprises an opening and the lid closes the opening.

A method of using a storage container comprises attaching a lid to a cleat; attaching the cleat to a structure; assembling a bag assembly comprising a bag supported on a bag support; suspending the bag assembly from the cleat. The step of assembling may comprise positioning a rim at a top edge of the bag under a flap. The step of assembling may comprise inserting a protrusion on rim into a slot formed on the flap. The step of attaching the cleat to a structure may comprise suspending the cleat from a hook. The step of suspending the bag assembly from the cleat may comprise suspending the bag from the cleat by inserting a hook into a slot on the cleat.

DETAILED DESCRIPTION OF EMBODIMENTS OF THE INVENTION

Figure 1:
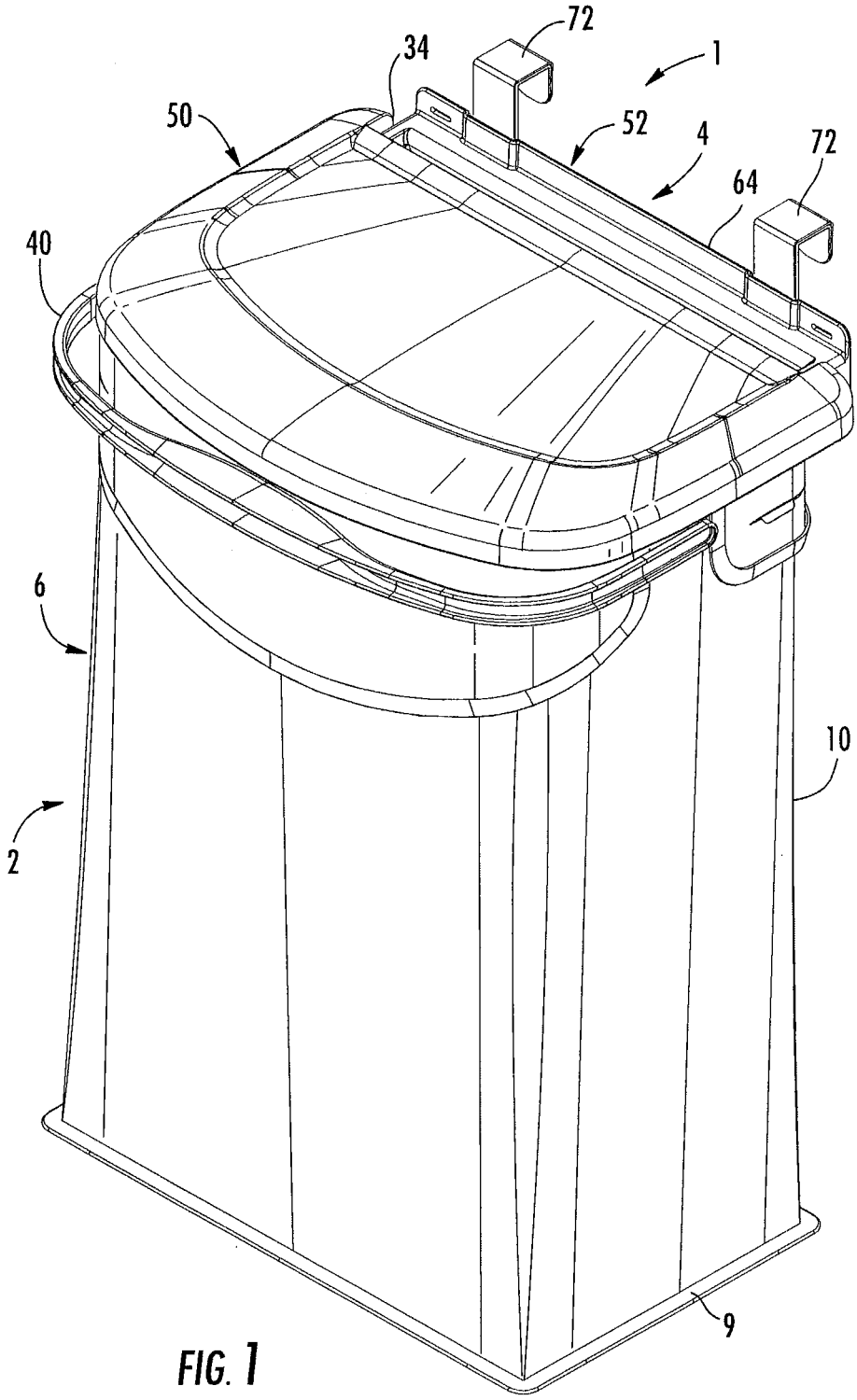
FIG. 1 is a perspective view of one embodiment of the storage container.
Figure 2:
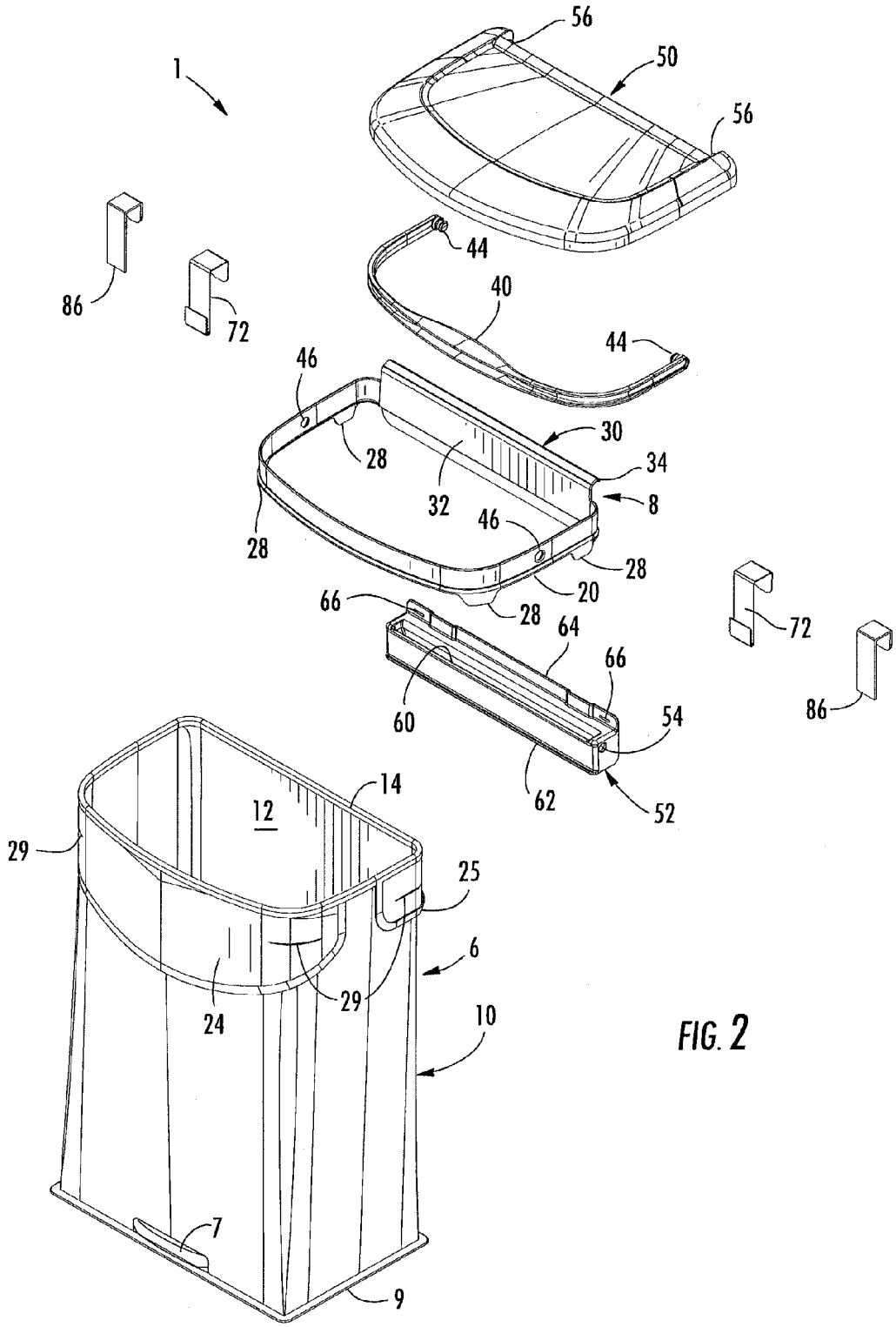
FIG. 2 is an exploded view of the storage container of FIG. 1.

An embodiment of the storage container 1 comprises a bag assembly 2 that is releasably mounted on a lid assembly 4. The lid assembly 4 is intended to be mounted on the back of a door or other vertical surface where it may be hidden from view. The bag assembly 2 may be easily removed from the lid assembly 4 to allow the user to carry the bag assembly and its contents to a remote location for disposal. Once emptied, the bag assembly 2 may be easily replaced on the lid assembly 4. In one embodiment the storage container is configured to be attached to the back of a cabinet door such as below a sink in a kitchen where the bag can be easily accessed during use but is hidden from view when not being used.

The bag assembly 2 comprises a bag 6 that is attached to a bag support 8 for supporting the bag 6 on the lid assembly 2. In one embodiment the bag 6 is made of a relatively flexible material such that the bag can collapse. While the bag 6 may be relatively flexible, a flexible material that has some stiffness is preferred to allow the bag to stand upright on its base on a floor or other surface when not mounted on the lid assembly 4. It is also desirable to provide a bag that is water impermeable to prevent leakage through the bag. Suitable materials are PET and RPET although any suitable material may be used. Further, while a collapsible bag is preferred to allow the bag to collapse when used in cramped areas such as under a sink or for storage, a rigid bag may also be used.

The bag 6 is provided with a base 9 and a side wall 10 that define an interior space 12 for receiving the recyclables or other articles. The side wall 10 terminates in a top edge 14 that defines an upward facing opening that provides access to the interior 12. In the illustrated embodiment the base 9 is planar such that the bag 6 may be supported on the base 9 with side wall 10 extending upwardly from the base. The bag 6 is shown as having a rectilinear shape where a rectangular base 9 supports a four-sided side wall 10; however, the bag may have other shapes. In the illustrated embodiment the bag 6 is formed with three flaps 24, 25, 26 that are connected to the bag at the top edge 14 of the bag and that extend downwardly from the top edge 14 along the side wall 10.

Figure 8:
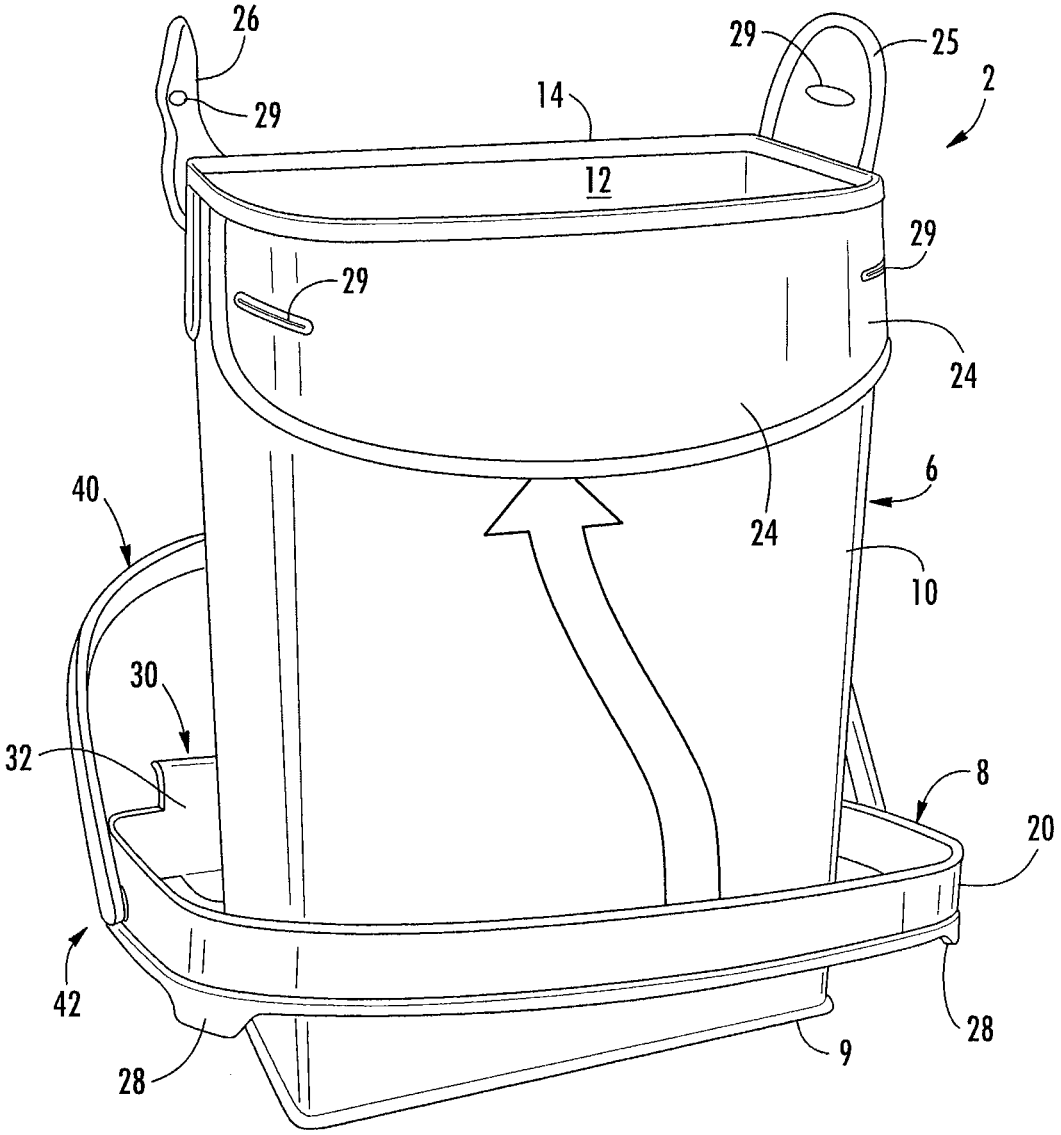
FIG. 8 illustrates a method of mounting a bag on the bag support.

The bag 6 is mounted to bag support 8 that supports the bag 6 on the lid assembly 4 as will be described. The bag support 8 comprises a rim 20 that is shaped generally as an annular ring. The rim 20 is dimensioned such that it is shaped and sized to conform to the top edge 14 of bag 6. The bag 6 is attached to the rim 20 such that the bag may be suspended from the bag support 8 with the rim maintaining the bag 6 in an open position. The periphery of the bag 6 may be attached to the rim 20 using any suitable connection method. The rim 20 may be attached to the top edge 14 of the bag 6 using a releasable connection mechanism such as screws, hook and loop fastener, snaps or the like such that the bag 6 may be easily removed from the bag support 8. The rim 20 may also be attached to the upper edge 14 of the bag 6 using a permanent attachment mechanism such as adhesive, rivets, stitching or the like. Because the entire bag assembly 2 including the rim 20 and the bag 6 is removable from the lid assembly 4 either a permanent or releasable attachment mechanism may be used; however, a releasable attachment mechanism allows the bag 6 to be removed from support 8 for cleaning, replacement and storage if desired. In the illustrated embodiment a releasable attachment mechanism is shown that does not require additional components. Referring to FIGS. 1 and 8, the bag 6 is positioned in the rim 20 such that the side wall 10 of the bag 6 is located inside of the rim 20 with the flaps 24, 25 and 26 extending over the rim 20 such that the rim 20 is disposed in the space between the flaps 24, 25 and 26 and the side wall 10. The rim 20 is provided with four protrusions 28 spaced about the periphery of the rim 20. In the illustrated embodiment one protrusion 28 is formed adjacent each corner of the bag. The protrusions 28 are inserted into mating slits 29 formed in the flaps 24, 25 and 26 to retain the bag 6 on the rim 20. A single large flap 24 is provided along the front side of the bag 6 having two slits 29 and two smaller flaps 25 and 26 are provided along the back side of the bag 6 having one slit 29 in each flap. The rear flaps 25 and 26 are spaced from one another to accommodate hook member 30.

An attachment member 30 is formed along one side of the rim 20 to attach the bag assembly 2 to, and support the bag assembly on, the lid assembly 4. In use the hook member 30 is located along the rear of the bag assembly 2. The member 30 comprises a generally planar member 32 having a downwardly facing hook 34 disposed along the back side thereof. Hook 34 is formed on the side of planar member 32 opposite to rim 20 and faces away from the rim 20. While a single elongated hook 34 is shown that extends for substantially the entire width of the bag support 20 a plurality of smaller hooks may also be provided. The bag support 8 may be made of molded plastic as a one-piece member although the bag support 8 may be made of other materials and the rim 20 and attachment member 30 may be made separately from one another and joined together to create rim 20.

Figure 3:
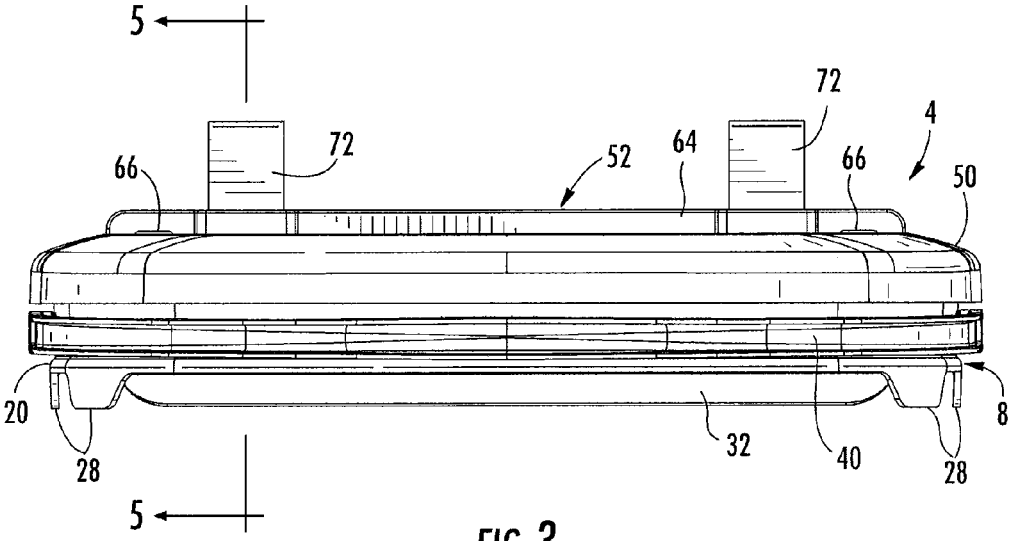
FIG. 3 is a front view of an embodiment of the lid assembly used in the storage container of FIG. 1.
Figure 4:
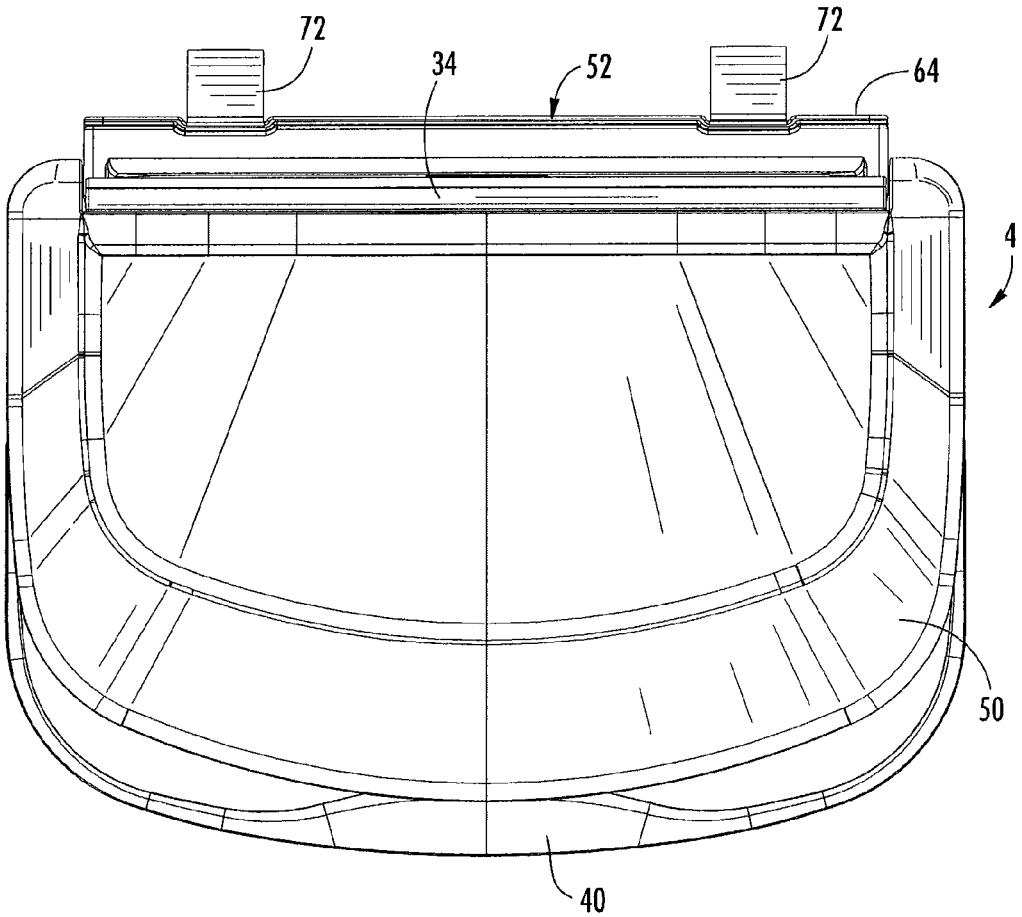
FIG. 4 is a top view of the lid assembly of FIG. 3.
Figure 6:
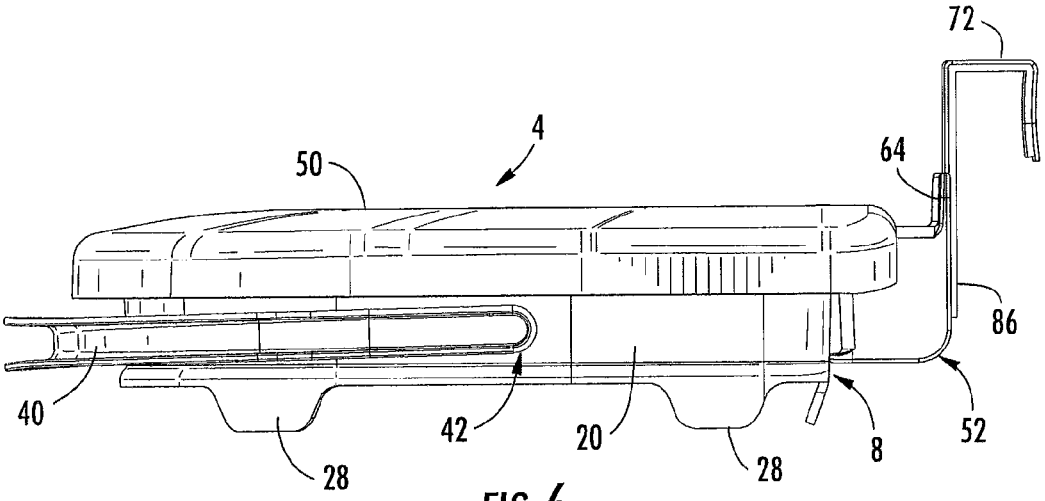
FIG. 6 is a side view of the lid assembly of FIG. 3.
Figure 7:
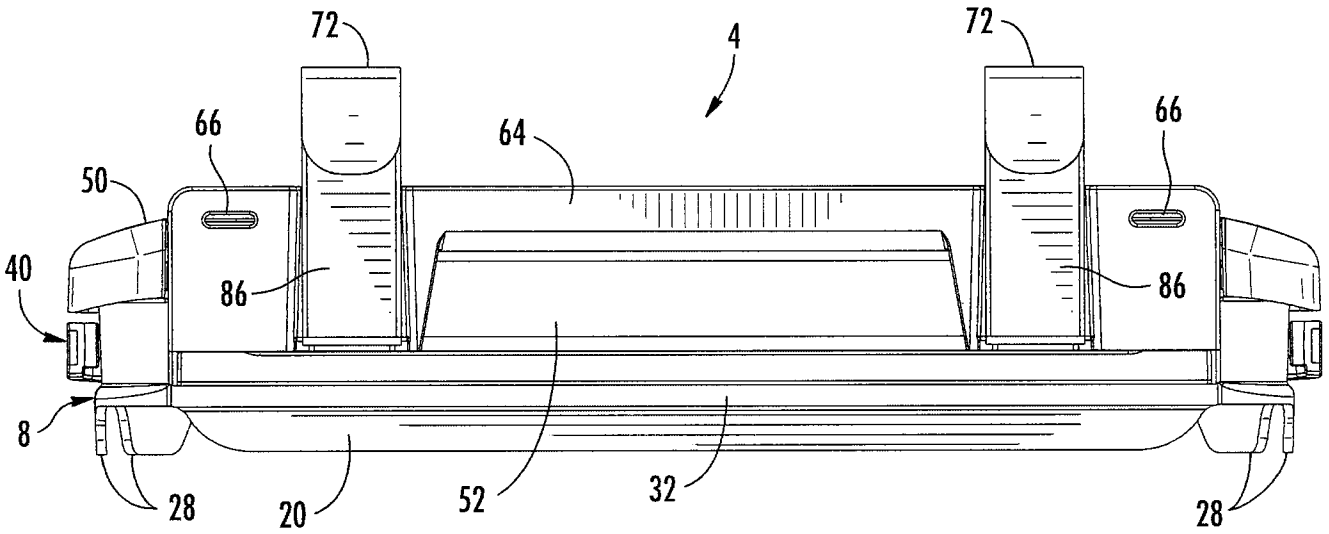
FIG. 7 is a back view of the lid assembly of FIG. 3.
Figure 9:
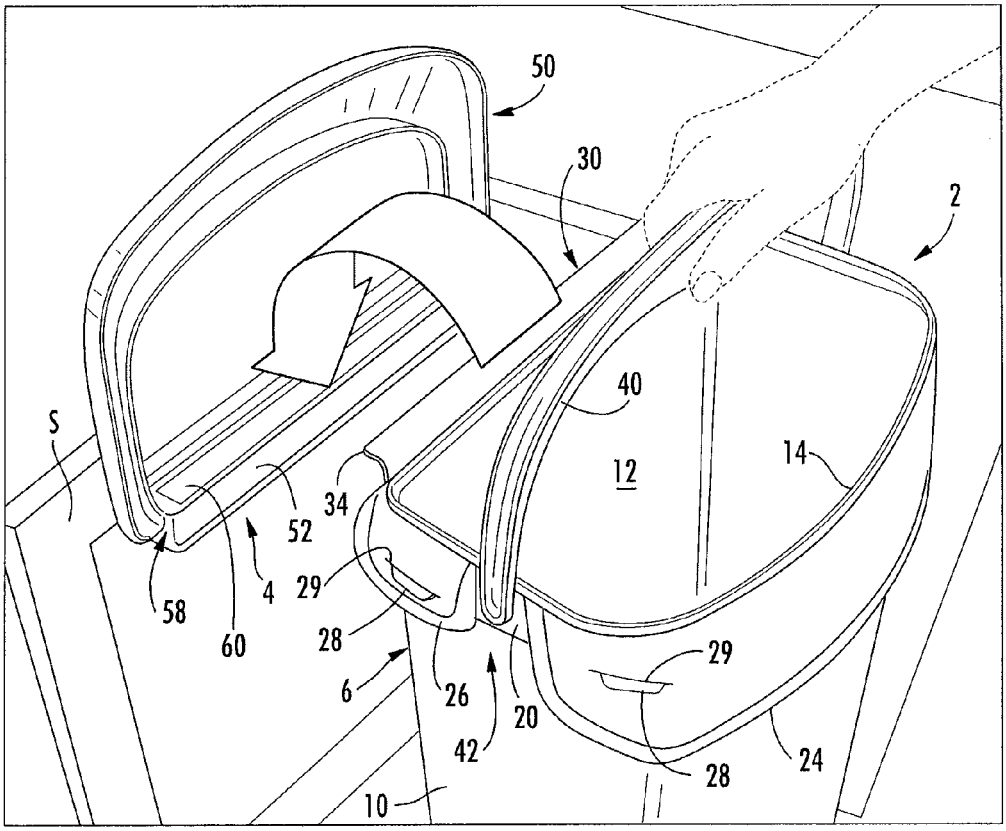
FIG. 9 illustrates a method of mounting the bag assembly on the lid assembly.

A handle 40 is secured to the rim 20 that may freely pivot between a first retracted storage position where it is stored as shown in FIGS. 1, 3 and 6 and a deployed position where it may be used by the end user to carry the bag assembly as shown in FIG. 9. In the storage position the handle 40 is disposed adjacent the top edge 14 of the bag 6 and in the deployed position the handle extends substantially vertically away from the bag 6. The handle 40 is formed as a movable member or bail that circumscribes approximately one half of the circumference of the rim 20 and is pivoted at each end at pivots 42 to the rim 20. Pivots 42 may comprise pins 44 that engage apertures 46 formed in rim 20 that are located along the centerline of the bag assembly 6.

Figure 10:
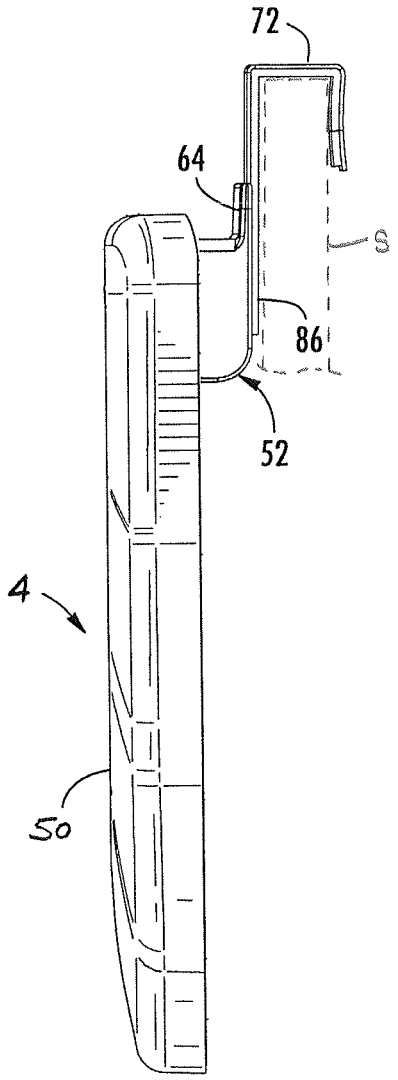
FIG. 10 is a side view showing the lid assembly extending downwardly.

The lid assembly 4 comprises a lid 50 that is pivotably attached to wall cleat 52 such that the lid 50 may freely pivot relative to the cleat 52. The cleat 52 comprises a box structure that extends for approximately the width of the bag support 8. The lid 50 is connected to cleat 52 at a hinge 58 such that the lid 50 may be pivoted relative to cleat 52. The hinge 58 may comprise an outwardly facing aperture 54 formed at each end of the cleat 52 and inwardly facing pivot pins 56 formed on lid 50. The pins 56 are received in the apertures 54 such that the pins may freely pivot in the apertures. The lid 50 may freely pivot relative to cleat 52. The lid 50 may pivot approximately 180 degrees between a first position where it extends upwardly to a substantially vertical position (FIG. 9) where the lid is over the cleat 52 and a second position where the lid extends downwardly to a substantially vertical position where it is suspended below the cleat 52 (FIG. 10).

Figure 5:
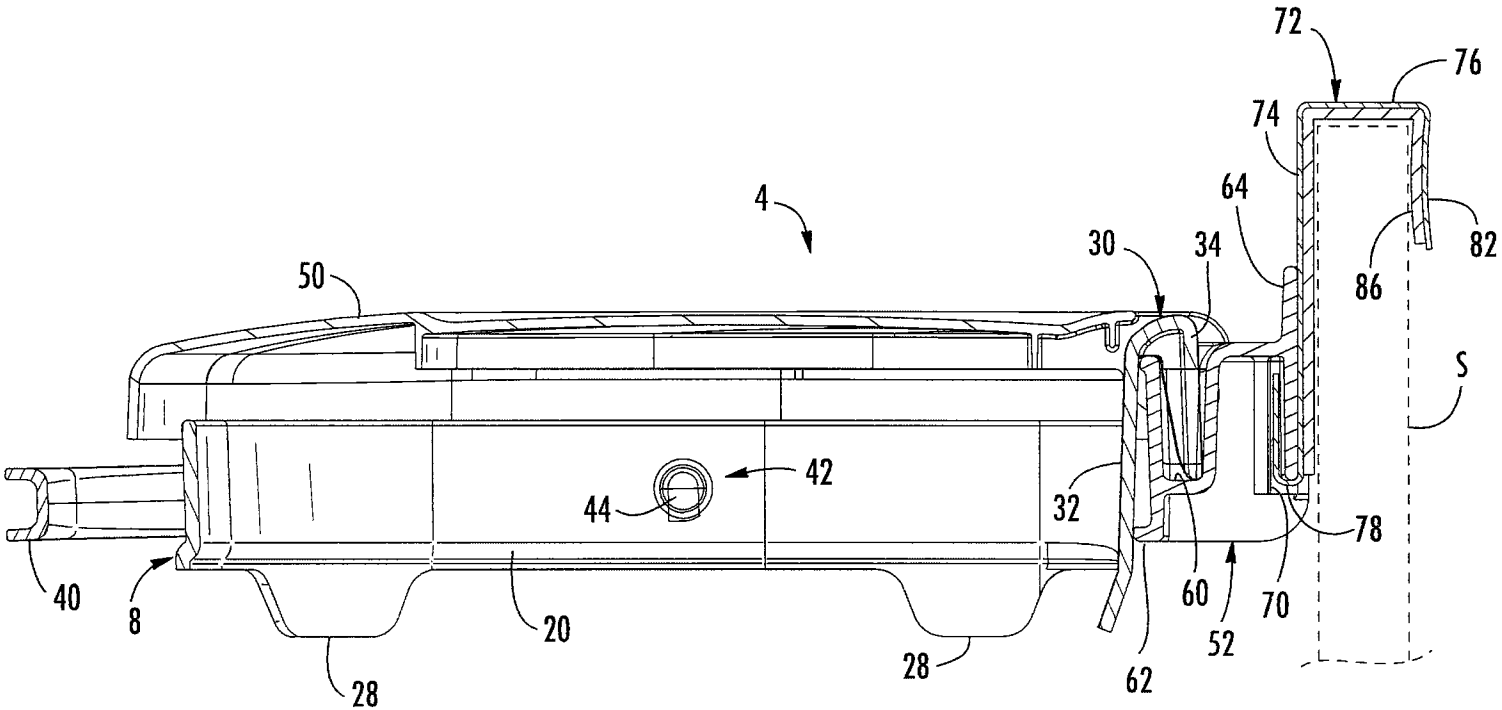
FIG. 5 is a section view taken along line 5-5 of FIG. 3.

An upwardly facing female receptacle or slot 60 is formed along the top of the cleat 52. The slot 60 is dimensioned to receive male member or hook 34 such that the rim 20 extends substantially horizontally from the cleat 52 as shown in FIG. 5. The cleat 52 may comprise structure such as horizontally extending flange 62 that abuts attachment member 30 to maintain the rim 20 in a substantially horizontal position. The rim 20 engages the flange 62 such that the rim 20, which has a tendency to rotate down due to gravity, is supported and maintained in the horizontal position. While the releasable connection between the bag assembly 2 and the lid assembly has been described specifically as a hook 34 and slot 60, a connection mechanism that allows the bag assembly to be quickly and easily attached to and removed from the lid assembly may be used. For example, the hook and slot may be replaced by a plurality of hooks that engage a plurality of slots or pins that engage corresponding holes or other male/female slide connection. The releasable connection allows the bag assembly 2 to be mounted to and detached from the lid assembly 4 with a single motion by the user without the need for separate fasteners or tools.

The cleat 52 also may include a vertically extending flange 64 along the back edge thereof that includes apertures 66 that may receive fasteners such as screws. The cleat 52 may be secured to the back of a door such as a cabinet door using the fasteners that engage apertures 66. Alternatively, slots 70 are formed along the back of the cleat 52 as shown in FIG. 5. The slots 70 receive hooks 72 configured such that the cleat 52 may be suspended on a door or other structure using the hooks 72. Each hook 72 comprises a vertical flange 74 that is connected to a top horizontal flange 76 at its top end and to a bottom horizontal flange 78 at its bottom end. The bottom horizontal flange 78 is connected to a upwardly extending flange 80 where the bottom horizontal flange 78 and the upwardly extending flange 80 are dimensioned such that the flange 80 may be inserted in slot 70. The top horizontal flange 76 is connected to a downwardly extending flange 82 where the top horizontal flange 76 and the downwardly extending flange 82 are dimensioned to allow the hook 72 to receive a structure S such as a cabinet door between flanges 74 and 82. The hooks 72 are arranged such that the cleat 52 is suspended adjacent the surface on which the hooks are mounted and the rim 20 extends at a right angle to the surface. In typical use where the hooks 72 are suspended on a vertical door the rim 20 extends substantially horizontally. Soft pads 86 may be attached to the inside surface of the hooks 72 to prevent the hooks from marring the structure on which they are suspended.

In use the lid assembly 4 is connected to a vertical surface such as the back of a cabinet door. The lid assembly 4 is connected to the surface by attaching the cleat 52 to the surface using either the hooks 72 or fasteners engaged with apertures 66. The lid 50 may be suspended downwardly from the cleat 52 for storage when no bag assembly 2 is present or the lid 50 may be lifted vertically to attach the bag assembly 2 to the lid assembly 4. Referring to FIG. 8, the bag assembly may be assembled by inserting the bag 6 into rim 20 and positioning the rim 20 at the top edge 14 of the bag 6 under flaps 24, 25 and 26. The protrusions 28 on rim 20 are inserted into the slots 29 formed on the flaps 24, 25 and 26 to secure the bag 6 in the bag support 8. The lid 50 is lifted to the upwardly extending vertical position to uncover the cleat 52 as shown in FIG. 9. The bag assembly 2 is lifted by handle 40 and suspended from the cleat 52 by engaging hook 34 with slot 60. The bag assembly 2 may be attached to the lid assembly 4 quickly and easily without requiring any additional fasteners and without using any tools. The handle 40 is rotated to the storage position and the lid 50 may be closed to cover the opening of the bag 6. The lid 50 may be lifted to allow access to the bag such that recyclables or other articles may be disposed of in the bag. To dispose of the contents of the bag, the lid 50 is lifted to the upwardly extending vertical position of FIG. 9. The bag assembly 2 is lifted from the lid assembly 4 using handle 40. The bag 6 may be inverted to dump the contents from the bag. To facilitate the dumping of the bag 6, a handle 7 such as a canvas handle may be secured to the bag 6 near the base 9 of the bag. The handle 7 may be provided on any side of the bag and more than one handle may be provided.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A storage container comprising:

a cleat configured to be connected to a structure, the cleat defined by a front wall, a rear wall, and a pair of side walls extending between the front wall and the rear wall, the cleat comprising a slot defined between the front wall, the rear wall, and the sidewalls;

a lid pivotably connected to the cleat, wherein the lid may pivot approximately 180 degrees between a first position where the lid extends upward substantially vertically from the cleat and a second position where the lid extends downward substantially vertically from the cleat;

a bag support configured to support a bag, the bag support comprising a rim, a vertically extending wall disposed on an interior of the rim, and a hook that extends outwardly and downwardly from a top portion of the vertically extending wall, the hook being insertable into the slot of the cleat to releasably connect the bag support to the cleat separate from the lid and to create a slide connection where the bag support may be connected to and released from the cleat by moving the bag support in a substantially vertical direction; and a handle pivotably secured to the bag support and movable between a retracted position where the handle is stored and deployed position where the handle may be used to move the bag support in the substantially vertical direction.

2. The storage container of claim 1 further comprising the bag made of a relatively flexible material.

3. The storage container of claim 1 wherein the rim is configured to support the bag, the lid being movable between a first position where the rim is covered and a second position where the rim is uncovered.

4. The storage container of claim 3 wherein the handle is positioned outside of the rim in the retracted position.

5. The storage container of claim 2 wherein the bag is attached to the rim such that the bag may be suspended from the rim and the rim maintains the bag in an open position.

6. The storage container of claim 5 wherein the bag comprises a plurality of spaced flaps defining a plurality of spaces between the flaps and a side wall of the bag, the bag being positioned in the rim such that the side wall of the bag is located inside of the rim and the flaps extend over the rim such that the rim is disposed in the spaces between the flaps and the sidewall, each flap comprising a slit and the rim comprising mating protrusions that are located on the rim and configured to engage the slits when the rim is disposed in the spaces between the flaps and the sidewall.

7. The storage container of claim 2 wherein the bag is attached to the bag support using a releasable connection mechanism.

8. The storage container of claim 1 further comprising a hook connected to the cleat for suspending the cleat from a structure.

9. A storage container comprising:

a cleat configured to be connected to a substantially vertical surface, the cleat defined by a front wall, a rear wall, and a pair of sidewalls extending between the front wall and the rear wall, the cleat comprising a slot defined between the front wall, the rear wall, and the sidewalls;

a lid pivotably connected to the cleat, wherein the lid may pivot approximately 180 degrees between a first position where the lid extends upward substantially vertically from the cleat and a second position where the lid extends downward substantially vertically from the cleat;

a bag support releasably connected to the cleat separate from the lid and comprising a rim, a vertically extending wall disposed on an interior of the rim, and a hook that extends outwardly and downwardly from a top portion of the vertical extending wall, the hook being insertable into the slot of the cleat to releasably connect the bag support to the cleat;

the lid being movable between a first position where the lid is disposed substantially horizontal and is disposed over the rim and a second position where the lid is suspended from the cleat and extends downwardly from the cleat substantially parallel to the surface when the bag support is removed from the cleat.

10. The storage container of claim 9 further comprising a handle pivotably secured to the bag support and movable between a retracted position where the handle is stored and a deployed position where the handle may be used to carry the bag support.

11. The storage container of claim 1 wherein the lid is connected to the cleat at a pivot, the pivot comprising a first member on the lid that releasably engages a second member on the cleat.

12. The storage container of claim 1, wherein the cleat further comprises a flange that extends outwardly from the front wall, and wherein the flange of the cleat abuts the rim of the bag support when the bag support is connected to the cleat, such that the cleat maintains the rim in a substantially horizontal position.

13. The storage container of claim 9, wherein the cleat further comprises a flange that extends outwardly from the front wall, and wherein the flange of the cleat abuts the rim of the bag support when the bag support is connected to the cleat, such that the cleat maintains the rim in a substantially horizontal position.

* * * * *